US008226205B2

(12) United States Patent
Izawa et al.

(10) Patent No.: US 8,226,205 B2
(45) Date of Patent: Jul. 24, 2012

(54) WIPING APPARATUS FOR PRINT HEAD

(75) Inventors: Hideo Izawa, Narashino (JP); Junichi Setoyama, Narashino (JP); Wataru Itabashi, Narashino (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 799 days.

(21) Appl. No.: 11/926,736

(22) Filed: Oct. 29, 2007

(65) Prior Publication Data

US 2008/0106571 A1 May 8, 2008

(30) Foreign Application Priority Data

Nov. 8, 2006 (JP) ..... 2006-302768

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 5,670,996 A * 9/1997 Mitani ..... 347/29
6,151,044 A * 11/2000 Gaasch ..... 347/33
6,913,338 B2 * 7/2005 Rhoads et al. ..... 347/28

FOREIGN PATENT DOCUMENTS

JP 10-95125 A 4/1998
JP 2005-319654 A 11/2005

* cited by examiner

*Primary Examiner* — Matthew Luu
*Assistant Examiner* — Alejandro Valencia
(74) *Attorney, Agent, or Firm* — Westerman, Hattori, Daniels & Adrian, LLP

(57) ABSTRACT

A wiping apparatus for a print head for wiping a head surface of the print head by rubbing the same with a blade is provided that includes a wiping box having a top open area; a blade support having the blade fastened thereto and disposed in an upper part of the wiping box so as to be rotatable between a wiping position at which a tip of the blade points upwards and a storage position at which the tip of the blade points downwards; leakproof plates fastened to the blade support for closing the top open area of the wiping box while the blade is in a state of the storage position; and a cleaning liquid nozzle disposed in the wiping box so that it is directed towards the blade in the storage position.

2 Claims, 5 Drawing Sheets

WIPING APPARATUS FOR PRINT HEAD

TECHNICAL FIELD

The present invention relates to an apparatus for wiping a head surface of a print head for use in an ink jet printer by rubbing the same with a blade, that is, a wiping apparatus for such a print head which renders the blade washable after wiping.

BACKGROUND ART

In a print head for an ink jet printer when loaded with ink or purged of ink by sucking ink through a head surface, ink adheres to the head surface. Accordingly, it is customary to wipe the head surface of the print head from time to time with a wiping apparatus attached to the ink jet printer.

In such a wiping apparatus, if ink adhering to the blade after wiping is left as it is, there is a fear that ink made high in viscosity or contaminants adhering together with ink which move to the head surface of the print head come to clog a nozzle.

In order to prevent this, it is customary that the blade which has wiped the head surface of the print head is flushed with a cleaning liquid from a nozzle and the cleaning liquid that adheres to the blade is wiped off by a wiping member (see, e.g., JP P 2005-319654 A). It is also customary that the blade after its wiping operation is immersed in a cleaning liquid for washing and then dried by a drying means (see, e.g., JP P H10-95125 A).

These conventional apparatuses have the problem that below the print head, they are exposed to the surroundings so that the cleaning liquid comes to be scattered into the environment. Especially in the former apparatus of the prior art in which the cleaning liquid is flushed from the nozzle and the liquid wiping is performed by a rotating wiping roll, there is the problem of scattering of the cleaning liquid. In the latter apparatus of the prior art, the drying efficiency was poor since the liquid is drawn and dried by the suction force of a suction pump. Furthermore, in both these apparatus, there was a fear that contaminants may adhere to the blade while not in use.

With the foregoing taken into account, it is an object of the present invention to provide a wiping apparatus for a print head which prevents scattering of a cleaning liquid when cleaning, allows drying after cleaning efficiently and prevents contaminants from adhering to the blade while not in use.

DISCLOSURE OF THE INVENTION

In order to achieve the object mentioned above, there is provided in accordance with the present invention in a first form of implementation thereof a wiping apparatus for a print head for wiping a head surface of the print head by rubbing the same with a blade, characterized in that it comprises: a wiping box having an open area at its top; a blade support having the blade fastened thereto and disposed in an upper part of the wiping box so as to be rotatable over between a wiping position at which a tip of the blade points upwards and a storage position at which the tip of the blade points downwards; a leakproof plate means fastened to the blade support for closing the top open area of the wiping box while the blade is in a state of the storage position; and a cleaning liquid nozzle disposed in the wiping box so that it is directed towards the blade in the storage position.

The present invention also provides in a second form of implementation thereof a wiping apparatus for a print head of the makeup mentioned above which further comprises an air nozzle disposed in the wiping box so that it is directed towards the blade in the storage position.

According to the first form of implementation of the invention described above which requires that the open area of the wiping box be closed with the leakproof plate means when the blade is moved to the storage position at which the blade points downwards to be washed, the cleaning liquid, if flushed forcibly from the cleaning liquid nozzle for washing the blade in this state, is prevented from running out through the upper part of the wiping box or scattering into the surroundings; it is possible to prevent the environment from becoming worse while a print head is cleaned up.

Also, holding the blade in the storage position within the wiping box whose open area is closed prevents contaminants from attaching to the blade while not in use prior to a wiping operation.

According to the second form of implementation of the invention described above, it is possible to dry the blade in the storage position with air from the air nozzle, to perform the drying with air within the wiping box immediately after flushing with the cleaning liquid without the latter scattered into the environment and to execute the washing and drying efficiently.

BEST MODES FOR CARRYING OUT THE INVENTION

Figure 1:
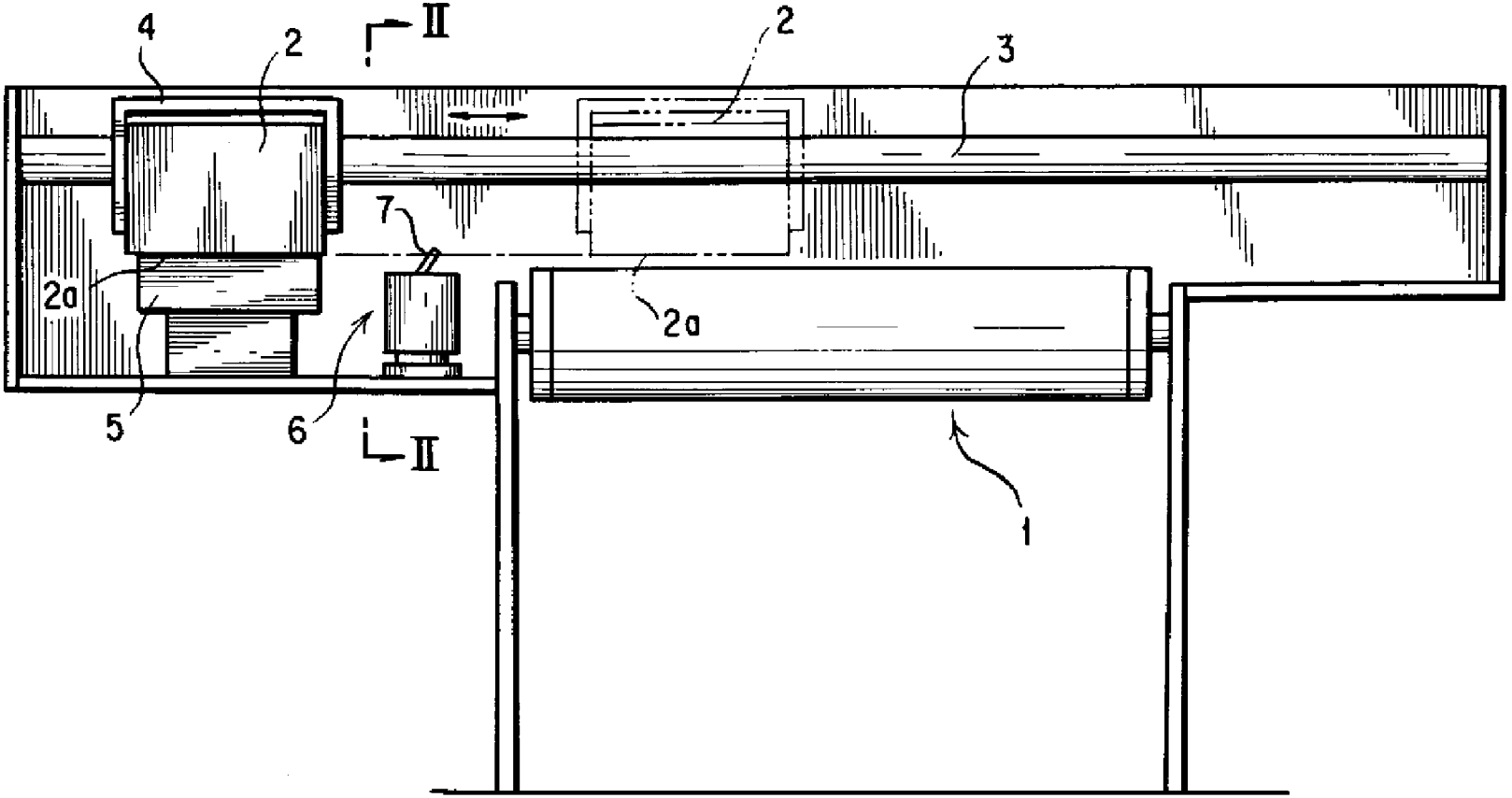
FIG. 1 is an explanatory view diagrammatically illustrating an ink jet printer, including a print head and a wiping apparatus therefor.

FIG. 1 is an explanatory view diagrammatically illustrating an ink jet printer. In FIG. 1, there are shown a conveyer unit 1 for conveying a substrate in a direction perpendicular to FIG. 1 and a print head 2 reciprocating in a transverse direction with respect to the conveyer unit 1 for printing on the substrate. The print head 2 is supported via a base mount 4 on a guide rail 3 mounted on a frame and is designed to be reciprocated by a drive unit (not shown). The print head 2 is also movable vertically with respect to the base mount 4.

The guide rail 3 is extended to and mounted over a maintenance section provided laterally of the conveyer unit 1 so that the print head 2 may be moved to above a purging unit 5 mounted on the maintenance section. And, between the purging and conveyer units 5 and 1 there is disposed a wiping apparatus 6 such that when the print head 2 having its head surface 2*a* through which ink is purged by the purging unit 5 is returned toward a printing position above the conveyer unit 1, the nozzle surface 2*a* is rubbed with a blade 7 of the wiping apparatus 6 and thereby wiped.

Figure 2:
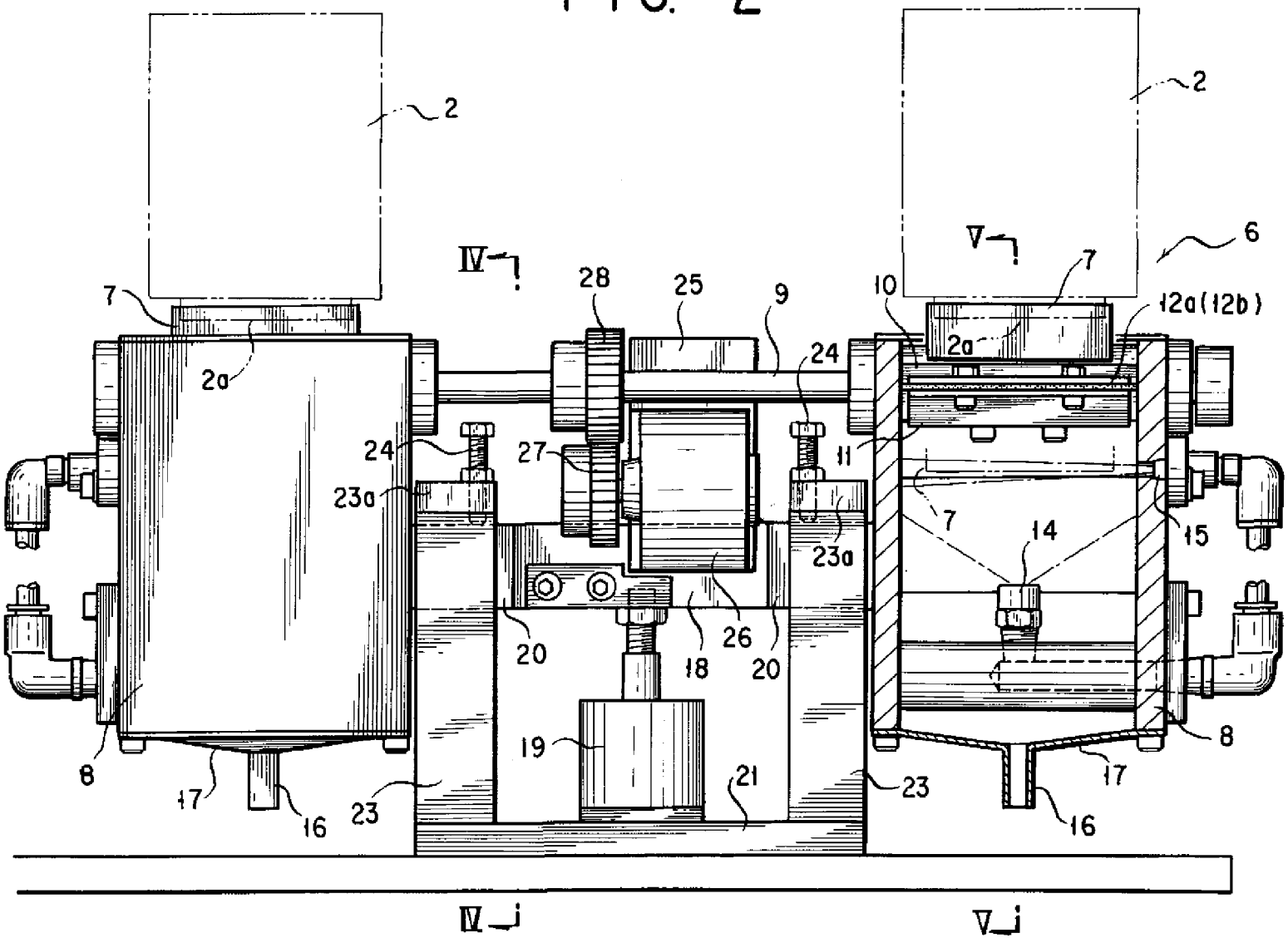
FIG. 2 is a cross sectional view, in part cut away, of the printer including the wiping apparatus taken along the line II-II in FIG. 1.
Figure 3:
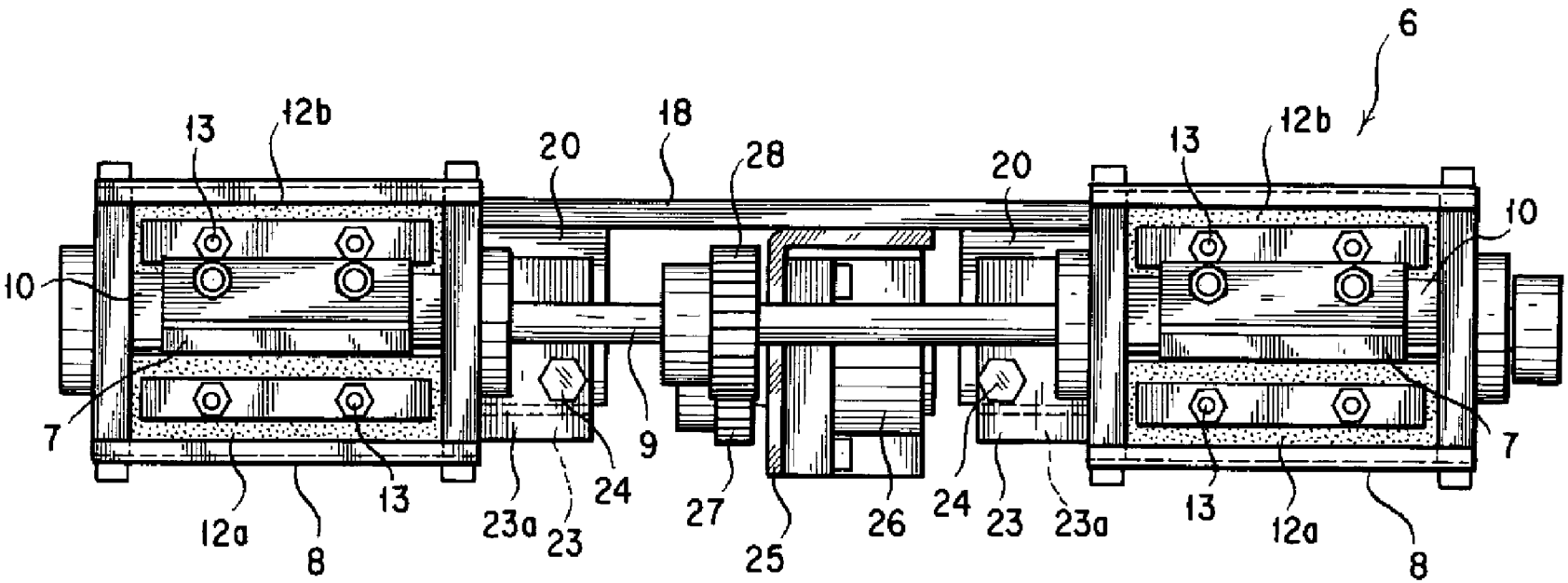
FIG. 3 is a plan view of the wiping apparatus.
Figure 4:
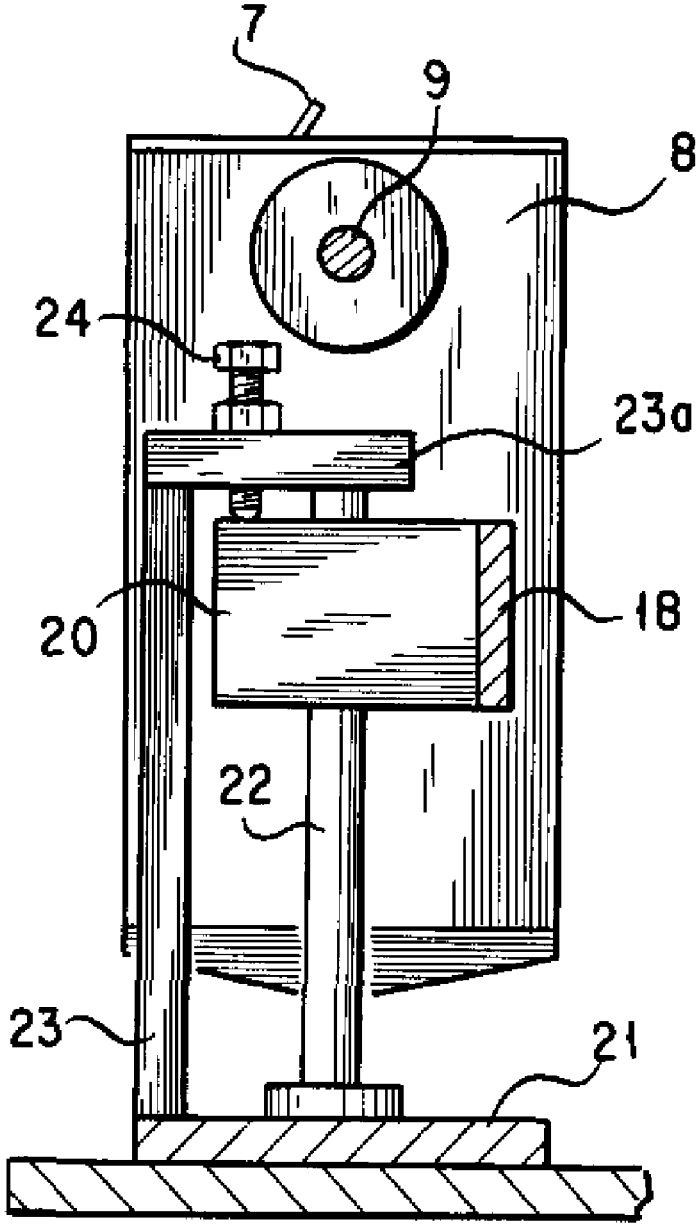
FIG. 4 is a cross sectional view of the wiping apparatus taken along the line IV-IV in FIG. 2.

Referring now to FIG. 2*ff*, mention is made of the wiping apparatus 6. FIG. 2 is a cross sectional view, in part cut away, of the printer including the wiping apparatus along the line II-II in FIG. 1 wherein an example using two wiping boxes 8 is shown. This is one in which two rows of print heads 2 each as shown in FIG. 1 are provided. And, the two wiping boxes 8 are identical in construction to each other, of one of which mention is made below. FIG. 3 is a plan view of the wiping apparatus; FIG. 4 is a cross sectional view of the wiping apparatus taken along the line IV-IV in FIG. 2; and FIGS. 5A and 5B are enlarged cross sectional views of the wiping apparatus taken along the line V-V.

A rotating shaft 9 is passed through and rotatably supported by the upper part of the wiping box 8 in a direction perpendicular to that in which the print head 2 is moved. And, the rotating shaft 9 has a blade support 10 fastened thereto to which the blade 7 is fastened so that it towards its upper side has a tilt to the conveyer unit 1 in the direction in which the print head 2 is moved. The blade 7 is made a little longer than a width of the head surface 2*a* of the print head 2. Further, the blade 7 is made of a plate material such as hard rubber or the like having a suitable elasticity.

The blade support 10 has a length such that its both ends are in contact with inner side surfaces of the wiping box 8. And, the blade support 10 as shown in FIGS. 5A and 5B has a support member 11 fastened thereto, of which support pieces 11*a* and 11*b* are extended to and disposed at both sides around the rotary axis 9, and leak-proof plates 12*a* and 12*b* are fastened to the support pieces 11*a* and 11*b* of the support member 11 by bolts 13.

Figure 5B:
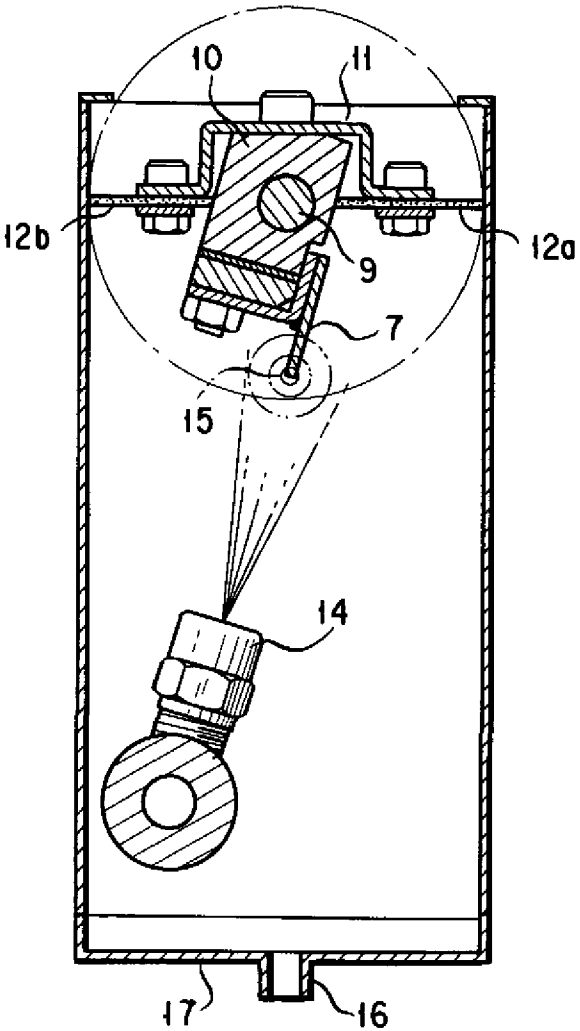
FIGS. 5A and 5B are cross sectional views of the wiping apparatus taken along the line V-V, illustrating its wiping and storage states, respectively.
Figure 5A:
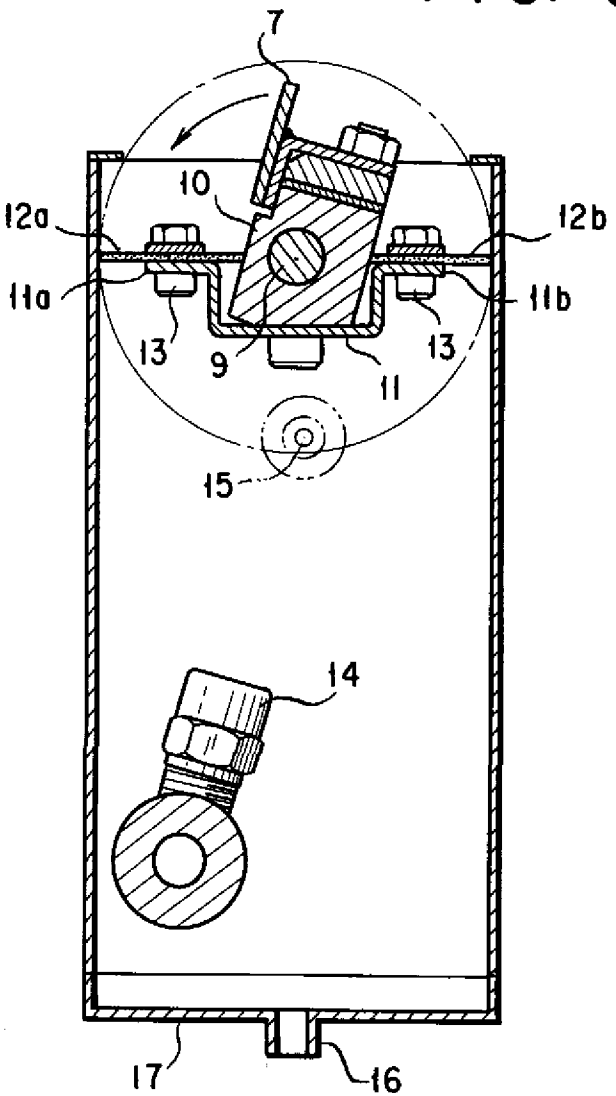

Rotating the rotating shaft 9 causes the blade support 10 to rotate from a wiping position as shown in FIG. 5A at which the blade 7 projects upwards to a storage position as shown in FIG. 5B at which the blade 7 points downwards by about 180 degrees. And, the two leakproof plates 12*a* and 12*b* when the blade support 10 lies at least at the storage position are oriented horizontally to hold their ends and side ends in contact with the inner surfaces of the wiping box 8, leaving no space between them. Here, the leakproof plates 12*a* and 12*b* may be made of elastic material such as rubber plate so that their ends and side ends make elastic contact with the inner surfaces of the wiping box 8.

Under the wiping box 8 there is disposed a cleaning fluid nozzle 14 directed towards the end of the blade in the storage state. A side wall of the wiping box 8 is formed with an air nozzle 15 laterally juxtaposed with the tip of the blade 7 in the storage state as mentioned above.

The wiping box 8 at its lower end is closed with a bottom plate 17 having a drain hole 16.

The wiping apparatus in this form of implementation comprises two of a wiping box 8 as mentioned above, and the two wiping boxes 8 and 8 as shown in FIG. 2 are disposed spacedly with each other and coupled to a frame 18 so that their blades 7 and 7 are opposed to the lower surfaces of print heads 2 and 2, respectively. This frame 18 is supported by a lifting unit 19 using an air cylinder. The frame 18 is also provided at its both ends with guide blocks 20 and 20 which are fastened to side walls of the wiping boxes 8 and 8, respectively. And, the guide blocks 20 and 20 are slidably fitted with posts 22 and 22 standing on a base plate 21. The posts 22 and 22 are respectively supported by stands 23 and 23 which stand on the base plate 21 and which have top plates 23*a* and 23*a* provided with stoppers 24 and 24 contacting with the upper ends of the guide blocks 20 and 20, respectively. The stopper 24 and 24 are each constituted by a bolt whose end position is made adjustable.

A rotary actuator 26 of 180° rotation is mounted on the frame 18 via a bracket 25 and has an output shaft coupled to the rotating shaft 9 via gears 27 and 28 so that when the rotary actuator 26 is operated to rotate the rotating shaft 9, the blades 7 and 7 rotate over a range of angles between the wiping position shown in FIG. 5A and the storage position shown in FIG. 5B.

Mention is made below of an operation of the wiping apparatus 6 constructed as mentioned above.

The print head 2 is first purged of ink trough the nozzles on the nozzle surface 2*a* by the purging unit 5 in the maintenance section. Thereafter, the print head 2 in returning to the printing position above the conveyer unit 1 is wiped of the nozzle surface 2*a* by the blade 7 of the wiping apparatus 8.

In the wiping apparatus 6 during this wiping operation, the rotary actuator 26 is driven to move the blade 7 to the wiping position at which it points upwards as shown in FIG. 5 while the lifting unit 19 is driven to move the wiping box 8 up to a position at which it is restrained by the stopper 24. At this move-up position, the head surface 2*a* in contacting with the blade 7 makes the blade tip moderately bend.

Moving the print head 2 towards the conveyer unit 1 in this state causes the nozzle surface 2*a* of the print head 2 to be rubbed by the blade 7 of the wiping apparatus 6 and ink adhering on the nozzle surface 2*a* to be thereby scraped and wiped off. And, as the blade 7 after the wiping operation has the ink adhering thereon which has been scraped and wiped off from the head surface 2*a*, this is cleaned by a cleaning operation.

The cleaning operation is performed as follows:

The rotary actuator 26 is driven to move the blade 7 to the storage position at which it point downwards. In this state as in the wiping position, the leakproof plates 12*a* and 12*b* extends horizontally and their ends and side ends are held in elastic contact with the inner surfaces of the wiping box 8 so that the upper part of the wiping box 8 is closed liquid-tight with the leakproof plates 12*a* and 12*b* and the both ends of the blade support 10.

In this state, a cleaning liquid is first flushed from the cleaning liquid nozzle 14. As the cleaning liquid nozzle 14 is then pointed towards the tip of the blade 7 in the storage position, the cleaning liquid is then flushed directly on the tip of the blade 7 to cause the ink adhering on the blade 7 to be washed off. Then, since as mentioned above the upper part of the wiping box 8 is closed liquid-tight, the cleaning liquid flushed from the cleaning liquid nozzle 14 is discharged through the drain hole 16 without running out through above the wiping box 8. The cleaning liquid then used may be purified water as an example. Further, if ink used for the print head 2 is dye or pigment ink, the cleaning liquid may use water but if it is UV ink, a special type of ink is used.

After the cleaning liquid is flushed over a time period in which to cause the ink adhered on the blade 7 to be washed out, the flushing is terminated. After then, air is flushed from the air nozzle 15 to dry the blade 7 wetted with the cleaning liquid.

The wiping apparatus 6 other than in the wiping operation is held lowered by the lift-down by the lifting unit 19 so that the wiping apparatus 6 is held not to interfere with the head surface 2*a* of the print head 2.

While in the forms of implementation described above a wiping apparatus is illustrated for an ink jet printer having two row of print heads 2 in which two wiping boxes 8 are arranged in parallel and their respective blades 7 and 7 are rotated by a single rotating shaft 9, it should be understood that the number of wiping boxes 8 is provided according to the number of print heads 2 and that if the ink jet printer is of multi-color type requiring three or more print heads 2, a necessary number of wiping boxes 8 are provided accordingly. The blades 7 then provided can be operated with a single rotating shaft 9 as in the structure shown in FIG. 2 and can be operated with a single rotary actuator 26 as well. Further, the lifting unit 19 may be used in common for them.

What is claimed is:

1. A wiping apparatus for a print head for wiping a head surface of the print head by rubbing the same with a blade, characterized in that it comprises:

a wiping box having an open area at its top;

a rotating shaft passing through and rotatably supported by an upper part of the wiping box in a direction perpendicular to that in which the print head is moved;

a blade support fastened to the rotating shaft and having the blade fastened thereto and disposed in an upper part of said wiping box so as to be rotatable between a wiping position at which a tip of the blade is positioned outside the wiping box, pointing upwards and a storage position at which the tip of the blade is positioned inside the wiping box, pointing downwards;

a pair of leakproof plate means fastened to opposite sides of a rotary axis of said blade support and oriented horizontally to hold their ends and side ends in contact with inner surfaces of the wiping box for closing the top open area of said wiping box while the blade is in a state of said storage position; and a cleaning liquid nozzle disposed in said wiping box so that it is directed towards the blade in said storage position.

2. A wiping apparatus for a print head as set forth in claim 1, characterized in that it further comprises an air nozzle disposed in said wiping box so that it is directed towards the blade in said storage position.

* * * * *